US008020798B2

(12) United States Patent
Hasegawa

(10) Patent No.: US 8,020,798 B2
(45) Date of Patent: Sep. 20, 2011

(54) PULVERIZER

(75) Inventor: Takashi Hasegawa, Sakai (JP)

(73) Assignee: Micropowtec Corporation, Sakai-Shi, Fujui (JP)

( * ) Notice: Subject to any disclaimer, the term of this patent is extended or adjusted under 35 U.S.C. 154(b) by 114 days.

(21) Appl. No.: 12/524,753

(22) PCT Filed: Feb. 1, 2008

(86) PCT No.: PCT/JP2008/051661

§ 371 (c)(1),
(2), (4) Date: Jul. 28, 2009

(87) PCT Pub. No.: WO2008/093839

PCT Pub. Date: Aug. 7, 2008

(65) Prior Publication Data

US 2010/0108791 A1 May 6, 2010

(30) Foreign Application Priority Data

Feb. 2, 2007 (JP) ..... 2007-024409
Jan. 21, 2008 (JP) ..... 2008-010679

(51) Int. Cl.
*B02C 19/06* (2006.01)

(52) U.S. Cl. ..... 241/39; 241/5; 241/80; 241/284

(58) Field of Classification Search ..... 241/284, 241/80, 79, 39, 5, 40
See application file for complete search history.

(56) References Cited

U.S. PATENT DOCUMENTS

| | | | | |
|---|---|---|---|---|
| 403,970 | A * | 5/1889 | Sturtevant | 241/47 |
| 479,547 | A * | 7/1892 | Blass | 241/47 |
| 2,208,146 | A * | 7/1940 | Doyen | 422/209 |
| 4,733,826 | A | 3/1988 | Komori et al. | |

FOREIGN PATENT DOCUMENTS

| | | | |
|---|---|---|---|
| JP | 61-283361 | A | 12/1986 |
| JP | 3-109650 | U | 11/1991 |
| JP | 3-115046 | U | 11/1991 |
| JP | 2000-42438 | A | 2/2000 |

* cited by examiner

*Primary Examiner* — Faye Francis
(74) *Attorney, Agent, or Firm* — Knobbe, Martens, Olson & Bear, LLP

(57) ABSTRACT

A pulverizer simplified in structure for easy maintenance and suppressed in cost. The pulverizer has a hopper (2) provided on one side thereof, a product discharge hole (4) provided on the other side thereof, and a raw material crushing chamber (3) for crushing raw material that is fed from the hopper (2) and discharging the crushed material from the product discharge hole (4) . The pulverizer further has at least one thin plate-like rotor (8) disposed on the upstream side inside the raw material crushing chamber (3), a hollow circular cylindrical space (S1) in which the rotor is placed, a classifying space (C) disposed on the downstream side of the hollow circular cylindrical space (S1) and formed in a hollow circular cylindrical shape having an inner diameter smaller than the hollow cylindrical space (S1), and a product discharge hole (4) which is coaxially disposed on the downstream side of the classifying space (C) having an inner diameter smaller than the classifying space (C). Airflow produced by the rotation of the rotor (8) causes raw materials to collide with each other to crush them or causes raw materials to collide with the inner wall surface of the raw material crushing chamber to crush them.

6 Claims, 8 Drawing Sheets

PULVERIZER

This application is the U.S. National Phase under 35. U.S.C. § 371 of International Application PCT/JP2008/051661, filed Feb. 1, 2008, which claims priority to Japanese Patent Application No. 2007-024409, filed Feb. 2, 2007, and Japanese Patent Application No. 2008-010679, filed Jan. 21, 2008. The International Application was published under PCT Article 21(2) in a language other than English.

TECHNICAL FIELD

The present invention relates to a pulverizing apparatus having a raw material supply port provided in one end side, a product discharge port provided in the other side, and a raw material pulverizing chamber for pulverizing a raw material supplied from the raw material supply port so as to discharge from the product discharge port.

BACKGROUND ART

In each of industrial fields such as a food industry treating foods (green tea, soy, black tea, layer and the like), and the other medical drug and organic chemistry industry, more uniformized fine powders are demanded, and various pulverizing apparatuses have been developed.

For example, a pulverizing apparatus disclosed in Patent Document 1 described below has a pulverizing chamber passing through a rotating shaft, and is provided with a raw material supply port in one end and a product discharge port in the other end. A rotor provided with a blade in a leading end is attached to the rotating shaft, a liner is installed so as to oppose to the blade, and a partition plate is provided between the rotors. A rotary grind stone and a fixed grind stone are attached to a product discharge port side of the pulverizing chamber, a gap between the both grind stones forms a classifying gap, and a magnitude of the fine powder which can be introduced into the gap is limited by regulating a distance of the gap. The fine powder passing through the classifying gap is structured such as to be refined further by colliding against a triturating surface and fed to a discharge side.

Patent Document 1: Japanese Unexamined Patent Publication No. 2000-42438

DISCLOSURE OF THE INVENTION

Problems to be Solved by the Invention

However, since various kinds of members are necessarily provided within the pulverizing chamber, the pulverizing apparatus mentioned above has a complicated structure, and there has been a problem in view of maintenance and cost.

The present invention is made in view of the above-mentioned problems, and an object of the present invention is to provide a pulverizing apparatus in which a maintenance can be easily carried out by simplifying the structure and a cost is suppressed.

In order to solve the above problems, a pulverizing apparatus according to the present invention having a raw material supply port provided in one end side, a product discharge port provided in the other side, and a raw material pulverizing chamber for pulverizing a raw material supplied from the raw material supply port so as to discharge from the product discharge port, the pulverizing apparatus comprising:

a rotor arranged in an upstream side within the raw material pulverizing chamber and formed by at least one thin plate;

a cylindrical space in which the rotor is accommodated;

a classifying space arranged in a downstream side of the cylindrical space and having a cylindrical shape with an inner diameter set smaller than the cylindrical space; and the product discharge port arranged in a downstream side of the classifying space, wherein the pulverizing apparatus pulverizes by causing the raw materials to collide against each other, or causing the raw material to collide against an inner wall surface of the raw material pulverizing chamber, by a gas flow generated by a rotation of the rotor.

Operations and effects of the pulverizing apparatus having such structure will be described. The rotor formed by the thin plate is arranged in the upstream side of the raw material pulverizing chamber of the pulverizing apparatus, and the raw material pulverizing chamber generates the high-speed flow by rotating the rotor. The pulverization is carried out by causing the raw materials to collide against each other or causing the raw material to collide against the inner wall surface of the raw material pulverizing chamber, and is mainly based on a so-called air flow pulverization. The classifying space is provided in the downstream side of the cylindrical space in which the rotor is accommodated, and the inner diameter of the classifying space is set smaller than the cylindrical space. Further, the product discharge port is provided in the downstream side of the classifying space. Accordingly, the powders which do not become small to the predetermined grain size are pulverized until they become the predetermined grain size. Therefore, the product which is classified to the desired grain size is picked up. Further, the main member arranged within the raw material pulverizing chamber is only the rotor, and the classifying function and the like can be supported by the shape of the classifying space or the like. In other words, the desired pulverization can be carried out by contriving the shape of the inner wall surface of the raw material pulverizing chamber. As a result, it is possible to provide the pulverizing apparatus in which the maintenance can be easily carried out by simplifying the structure, and the cost is suppressed.

In the present invention, it is preferable that the rotor is structured such that a plurality of rotors are arranged side by side along a direction of a rotating axis, and regulates a grain size of a product by structuring an arrangement interval of the rotors adjustable.

It is possible to regulate the grain size only by changing the arrangement interval of the rotors, and any special member for regulating the grain size is not necessary. Accordingly, a simple structure can be obtained.

The classifying space according to the present invention is preferably has at least two classifying space portions having different inner diameters, and is set such that the inner diameter becomes smaller toward a downstream side.

By providing the classifying space portions having the inner diameter gradually different as mentioned above, it is possible to reliably prevent the product which is not pulverized to the predetermined grain size from being discharged from the product discharge port, and it is possible to obtain the product having more uniform grain size.

In the present invention, it is preferable that the classifying space is adjacent to the cylindrical space and is provided with a taper space portion in which the inner diameter becomes gradually smaller as being far from the cylindrical space.

With such a structure, the raw material pulverized at the position of the rotor is easily delivered in the direction of the classifying space.

Preferably, the pulverizing apparatus according to the present invention includes a bypass path arranged in an outer portion of the classifying space and bypassing a leading end side of the classifying space from an upstream side of the classifying space; and an internal path arranged in an inner portion of the classifying space and connected from the leading end side of the classifying space to the upstream side of the classifying space, wherein the pulverizing apparatus is structured such as to return a coarse grain discharged to the bypass path side, in the pulverized raw material, again into the classifying space via the internal path.

According to this structure, the coarse grain which is not pulverized to the predetermined grain size is returned again to the upstream side of the classifying space via the bypass path and the internal path. Since only the fine powder which is pulverized to the predetermined grain size is discharged from the product discharge port, it is possible to obtain the product having more uniform grain size. Note that it is sufficient that the upstream side of the classifying space is positioned in the upstream side of the leading end side of the classifying space.

In the present invention, it is preferable that a plurality of connecting portions for connecting the bypass path are provided in an outer portion of the classifying space, and are selectable in correspondence to a grade of the raw material.

According to this structure, it is possible to set the suitable bypass path in correspondence to the grade of the raw material. As the grade, for example, a specific gravity of the raw material can be listed up. In the raw material having a relatively high specific gravity, the bypass path is configured by utilizing the connection portion arranged in the downstream side. Accordingly, it is possible to carry out the pulverizing process more efficiently.

DESCRIPTION OF THE REFERENCE NUMERALS

Figure 1:
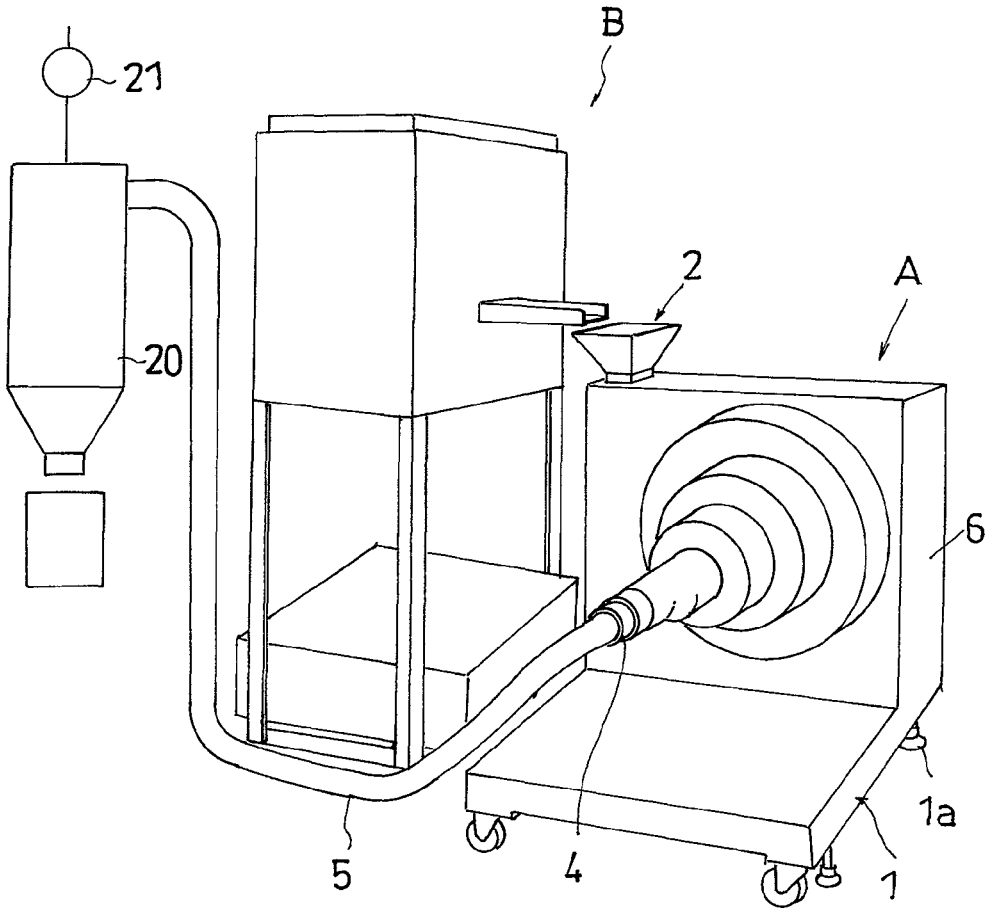
FIG. 1 is a perspective view showing an outer appearance of a pulverizing apparatus.

A Pulverizing apparatus
B Raw material supply apparatus
C Classifying space
S1 Cylindrical space
S2 Taper space portion
S3 First classifying space portion
S4 Second classifying space portion
P Bypass path
Q Internal path
1 Base
2 Hopper
3 Raw material pulverizing chamber
4 Product discharge port
7 Motor
8 Rotor
8*a* Hole portion
8*b* Blade portion
10, 11, 12, 13 Inner wall surface
15 First connecting portion
16 Second set portion
17 Leading end connecting portion

BEST MODE FOR CARRYING OUT THE INVENTION

Figure 2:
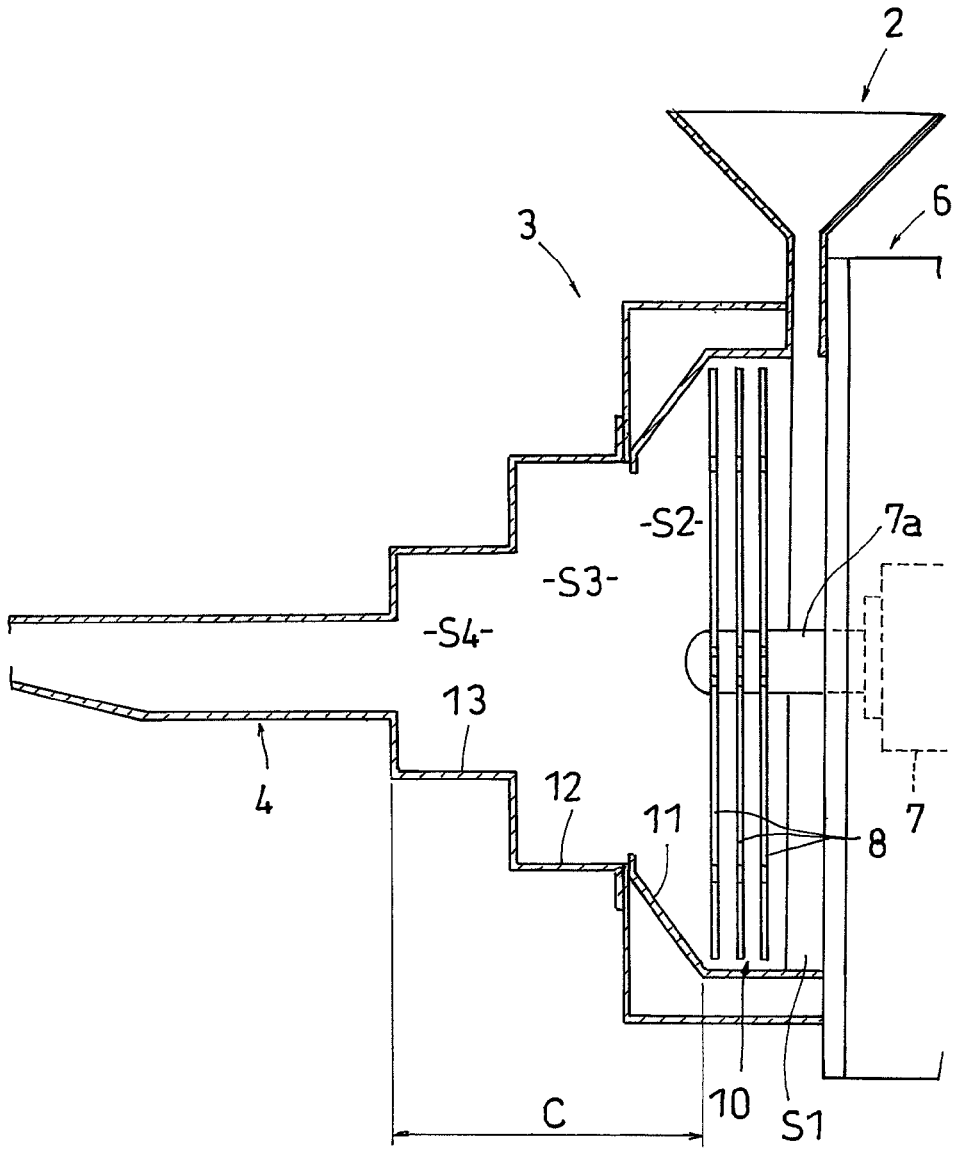
FIG. 2 is a cross sectional view showing an internal structure of the pulverizing apparatus.

Preferred embodiments of a pulverizing apparatus according to the present invention will be described with reference to the accompanying drawings. FIG. 1 is a perspective view showing an outer appearance of a pulverizing apparatus, and FIG. 2 is a cross sectional view showing an internal structure of the pulverizing apparatus.

Structure of First Embodiment

First, a description will be given of a structure of a pulverizing apparatus A according to a first embodiment. The pulverizing apparatus A is provided with a roller 1*a* in a bottom portion of an approximately L-shaped base 1. Further, the pulverizing apparatus A includes a hopper 2 (a raw material supply port) to which a raw material from a raw material supply apparatus B supplying the raw material is supplied, a raw material pulverizing chamber 3 which pulverizes the raw material put therein from the hopper 2 into fine powders, and a product discharge port 4 which discharges the pulverized raw material as a product. The product discharged from the product discharge port 4 is sucked by a blower 21, and is accumulated by a cyclone dust collecting apparatus 20 through a tube 5.

In this case, in order to dissolve a negative pressure within the cyclone apparatus so as to easily accumulate the fine powders, a compressor for a positive pressure or a ring blower may be connected. The compressor or the ring blower can carry out a heat removing action of the pulverized fine powders.

As shown in FIG. 2, a drive main body portion 6 is provided on the base 1, and a motor 7 is installed in an inner portion thereof. A rotating shaft 7*a* of the motor 7 is set in a horizontal state, and three rotors 8 are attached to a leading end side of the rotating shaft 7*a*. An arrangement interval of these three rotors 8 can be regulated, whereby it is possible to carry out a pulverization and a regulation of a grain size which are suitable for a characteristic of the pulverized raw material. The rotor 8 is accommodated in a cylindrical space S1 having a cylindrical shape, and a gap between an inner wall surface 10 of the cylindrical space S1 and an outer peripheral surface of the rotor 8 is set to a slight magnitude.

Figure 3:
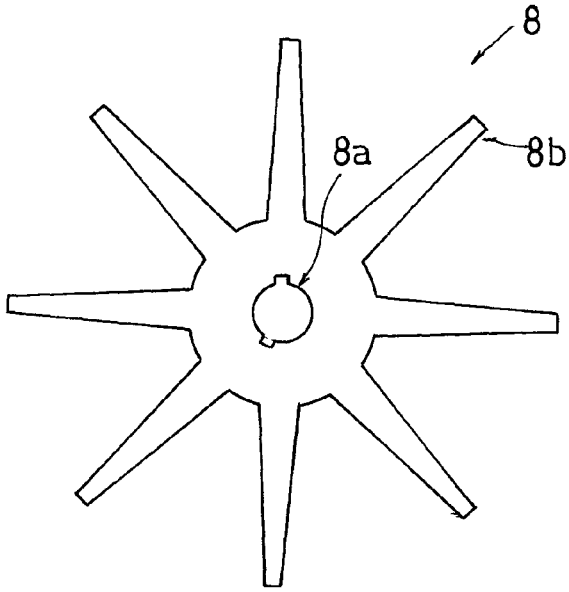
FIG. 3 is a plan view showing a shape of a rotor.

FIG. 3 is a plan view showing a shape of the rotor 8. A hole portion 8*a* coupled to the rotating shaft 7*a* is formed in a center portion of the rotor 8. Key grooves for coupling are formed at two positions of the hole portion 8*a*. Further, in the rotor 8, narrow blade portions 8*b* protrude radially at eight positions in the rotor 8 from a periphery of a small-diameter circular disc. These blade portions 8*b* are arranged at equal pitches along a circumferential direction. In this case, the number of the blade portions 8*b* and the like can be appropriately set.

Three rotors 8 may be structured such that their blade portions 8*b* have the same phase, or may be coupled while shifting their phases. The grain size can be made finer in the case that the phases are shifted.

If a dimension of a gap between the rotor 8 and the inner wall surface 10 is too small, a heat may be generated, and a trouble occurs when the raw material itself is large. On the contrary, if the dimension is too large, there is a problem that a pulverizing efficiency is greatly lowered. Accordingly, a suitable dimension is set in correspondence to a target grain size.

A classifying space C is arranged adjacent to a downstream side of the cylindrical space S1, and a taper space portion S2, a first classifying space portion S3 and a second classifying space portion S4 are arranged concentrically with the cylindrical space S1, in this order. The taper space portion S2 has a tapered inner wall surface 11 structured such that an inner diameter becomes smaller toward the downstream side.

The first classifying space portion S3 has a cylindrical shape with an inner diameter smaller than the cylindrical shape S1. A taper surface of the inner wall surface 11 of the taper space portion S2 is formed in such a manner that an inner wall surface 12 of the first classifying space portion S3 is continuously connected to the inner wall surface 10 of the cylindrical space S1. The second classifying space portion S4 has a cylindrical shape with an inner diameter smaller than the first classifying space portion S3. A product discharge port 4 is provided in a leading end portion of the second classifying space portion S4, and an inner diameter of the product discharge port 4 is smaller than an inner diameter of the second classifying space portion S4. The product discharge port 4 and the classifying space portions S3 and S4 are arranged so as to be concentric. Note that the product discharge port 4 is not necessarily arranged concentrically with the classifying space portions S3 and S4.

As mentioned above, the classifying space C is set such that the inner diameter becomes smaller toward the downstream side, and is structured such that only the product which is pulverized to a predetermined grain size can be discharged from the product discharge port 4.

<Operation>

Figure 4:
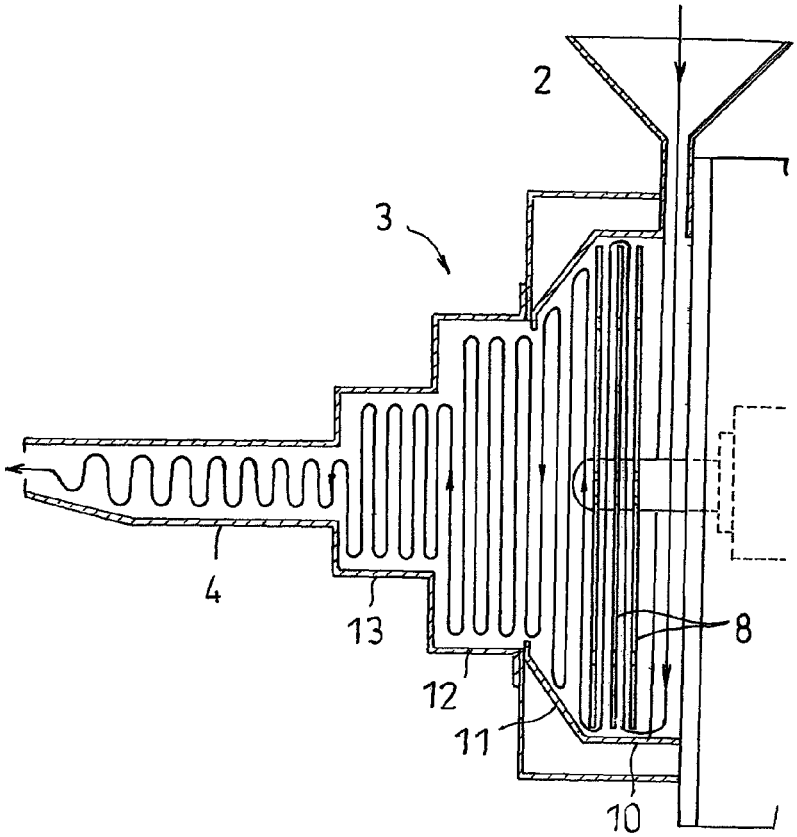
FIG. 4 is a view showing an operation of a raw material within the pulverizing apparatus.

Next, an operation of the pulverizing apparatus A according to the present invention will be described. FIG. 4 is a view showing a movement of the raw material until the raw material put therein from the hopper 2 is discharged from the product discharge port 4. A sucking operation is carried out by a blower connected to the product discharge port 4, and the rotor 8 is rotated at a high speed. A negative pressure is generated together with a high-speed rotation of the rotor 8, and a force intending to be pulled to the motor 7 side competes with a suction force generated by a blower 21, however, the suction force of the blower 21 is set so as to become larger.

Accordingly, the inserted raw material is pulverized gradually based on a repetition of a collision between the raw materials and a collision between the raw material and the inner wall surface 10 by a high-speed flow. The raw material flows to a downstream side while passing through the gap between the rotor 8 and the inner wall surface 10, and between the rotor 8 and the rotor 8.

In the classifying space C in the downstream side of the rotor 8, an eddy current is generated by the high-speed flow. With a centrifugal force generated by this eddy current, the raw material which is not sufficiently pulverized is blown away in a direction of the inner wall surfaces 11, 12 and 13, and only the raw material which is sufficiently pulverized is discharged from the center product discharge port 4. The inner wall surface 12 and the inner wall surface 13 form a step surface, and prevent the raw material which is not sufficiently pulverized from being carelessly discharged from the product discharge port 4. Accordingly, only the raw material which is pulverized to the desired grain size is picked up as the product, and the uniform fine powders can be obtained.

<Action and Effect>

According to the pulverizing apparatus A of the present invention, since the air flow type pulverization is employed, it is possible to suppress a temperature rise as much as possible. Further, since there is no collision portion between metals, metal powders do not mix in, and there is obtained a structure in which a trouble is hard to be generated.

The grain size can be regulated by regulating a rotating speed of the rotor 8 or a suction gas volume of the blower 21 in addition to the setting the interval of the rotors 8 mentioned above, and it is possible to regulate the grain size with an extremely simple operation. Further, the rotor 8 can be formed as a thin disc shape having a thickness of about some millimeters, the rotor 8 can be made light, and it is possible to downsize power equipment for driving the rotor 8.

The pulverizing apparatus A according to the present invention has a simple structure within the raw material pulverizing chamber, can easily carry out maintenance such as disassembly and cleaning and the like, and can suppress a cost of the apparatus itself. Further, a magnitude of the whole apparatus is compact, and a wide installing place is not necessary.

In the present invention, since the air flow type pulverization is employed, it is possible to uniformly pulverize even a raw material which comparatively includes a lot of oil content such as a soy or the like which is assumed to be hard to be mechanically pulverized. Further, since the inserted raw material is pulverized in an instant and is discharged from the product discharge port 4, it has an advantage that an alteration of the raw material such as a deterioration of a flavor is hard to be generated.

According to the pulverizing apparatus A of the present invention, since the apparatus is structured such that only the fine powders having the desired grain size are discharged, it is possible to pulverize a single micron size and a sub micron size through one pass.

<Results of Experiment>

Figure 5:
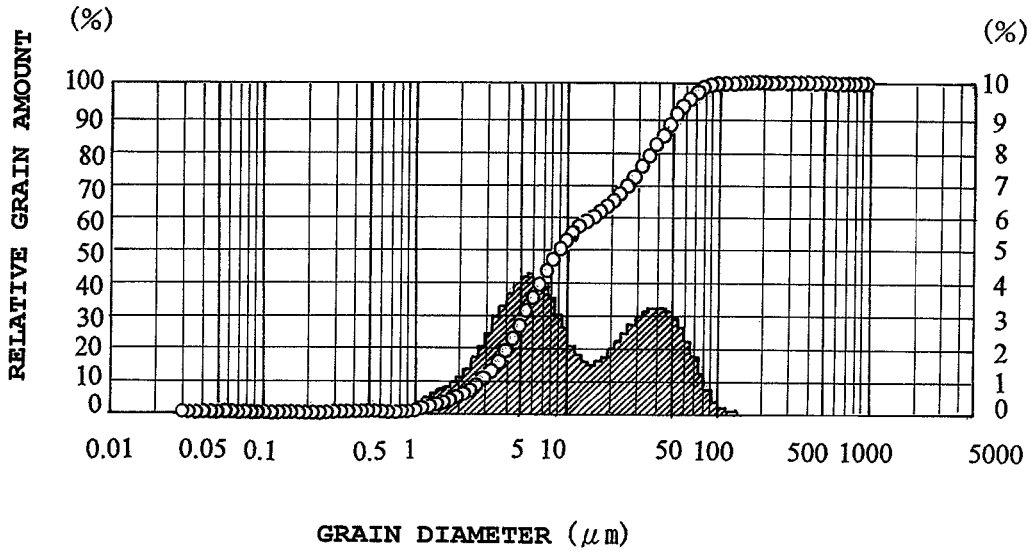
FIG. 5 is a view showing a result of pulverizing experiment (vitamin B2) .
Figure 6:
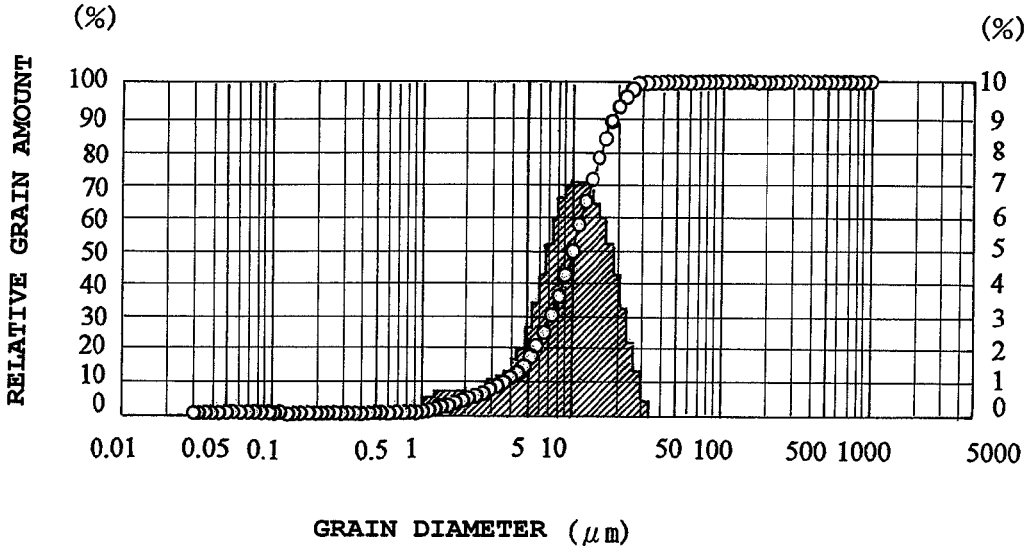
FIG. 6 is a view showing a result of pulverizing experiment (vitamin C).
Figure 7:
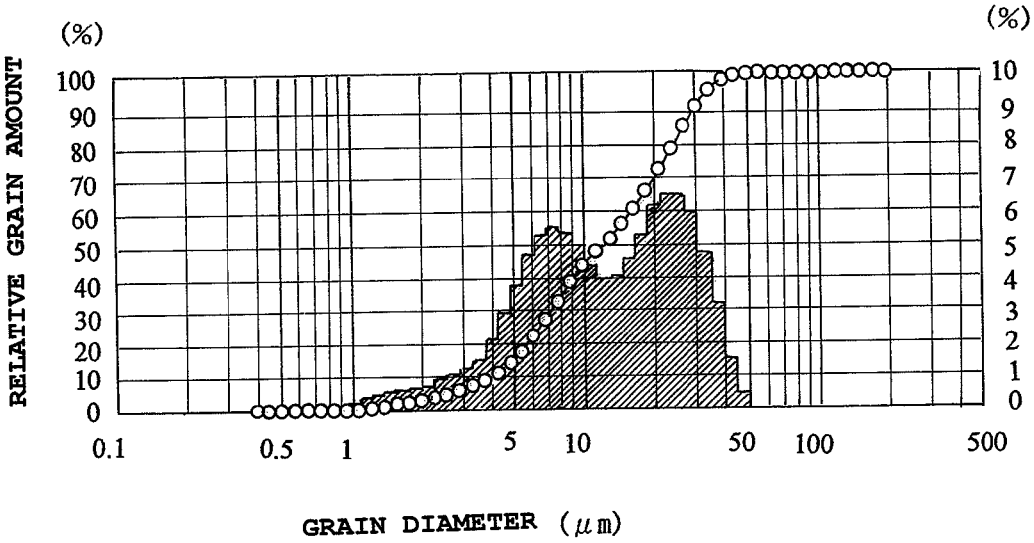
FIG. 7 is a view showing a result of pulverizing experiment (rice powder).
Figure 8:
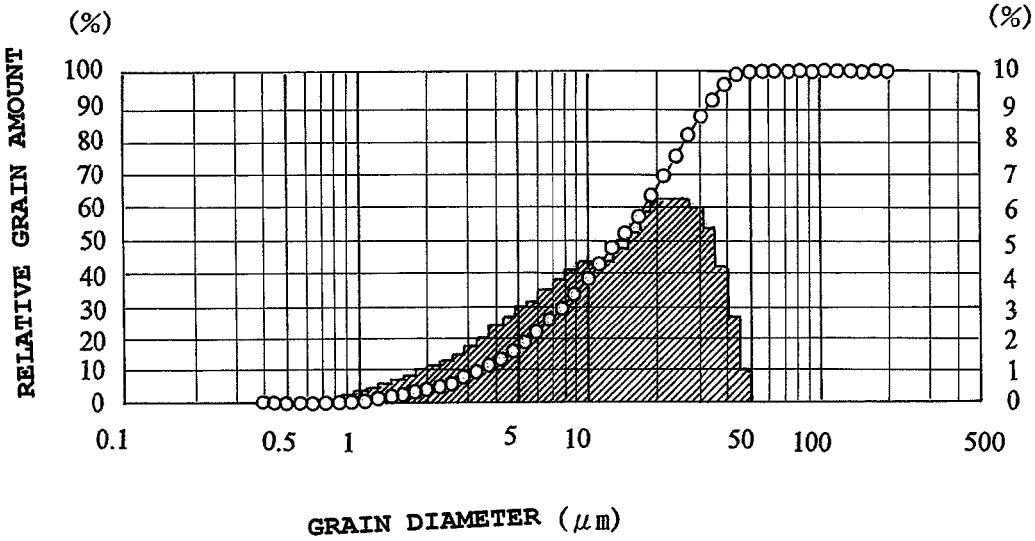
FIG. 8 is a view showing a result of pulverizing experiment (tea).

Next, results obtained by actually carrying out a pulverizing experiment are shown in FIGS. 5 to 8. FIG. 5 shows vitamin B2, FIG. 6 shows vitamin C, FIG. 7 shows rice powder, and FIG. 8 shows tea. A horizontal axis indicates a diameter of a particle after pulverizing, a left vertical axis indicates a relative particle weight (%), and a right vertical axis indicates a contained rate of each of the particle diameters. In FIGS. 5 and 7, since the raw material is inserted manually, the peaks are formed at two positions, however, in FIGS. 6 and 8, the raw material is automatically supplied by the raw material supply apparatus B.

The vitamin B2 and the vitamin C both show the results obtained by pulverizing those having magnitudes between 200 and 300 μm. As shown in the result of pulverization, in the case of the vitamin B2, a median diameter was 9.263 μm, and an average diameter was 11.256 μm. In the case of the vitamin C, a median diameter was 10.212 μm, and an average diameter was 9.176 μm. Although the vitamin has a weakness for heat, it is possible to suppress the temperature rise, and it is possible to pulverize to the desired grain size according to the structure of the present invention.

In the case of the rice powder in FIG. 7, a median diameter was 12.388 μm, and an average diameter was 11.579 μm, and in the case of the tea in FIG. 8, a median diameter was 14.065 μm, and an average diameter was 11.970 μm.

Structure of Second Embodiment

Figure 9:
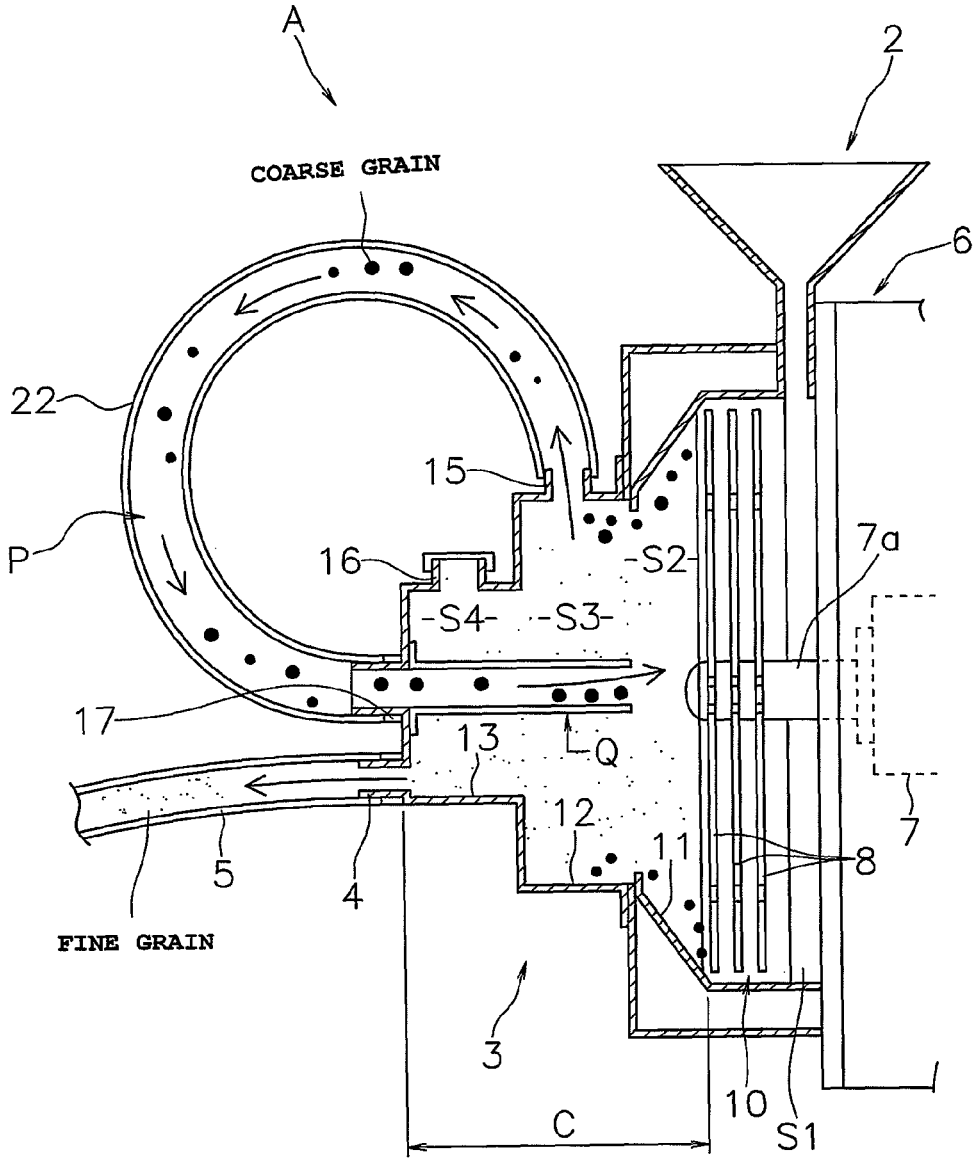
FIG. 9 is a cross sectional view showing an internal structure of a pulverizing apparatus according to a second embodiment.

Next, a structure of a pulverizing apparatus A according to a second embodiment will be described. The same reference numerals are denoted to portions having the same functions as those of the first embodiment. A description will be given mainly of a point different from the first embodiment. FIG. 9 is a cross sectional view showing an internal structure of the pulverizing apparatus according to the second embodiment, and FIG. 10 is a perspective view showing a part of an outer appearance thereof.

A first connecting portion 15 is provided in an outer portion of the first classifying space portion S3, and a second connecting portion 16 is provided in an outer portion of the second classifying space portion S4. Further, a leading end connecting portion 17 is provided in a leading end portion of the second classifying space portion S4. A pipe 22 is connected between the first connecting portion 15 and the leading end connecting portion 17, and a bypass path P is configured by the pipe 22.

Figure 10:
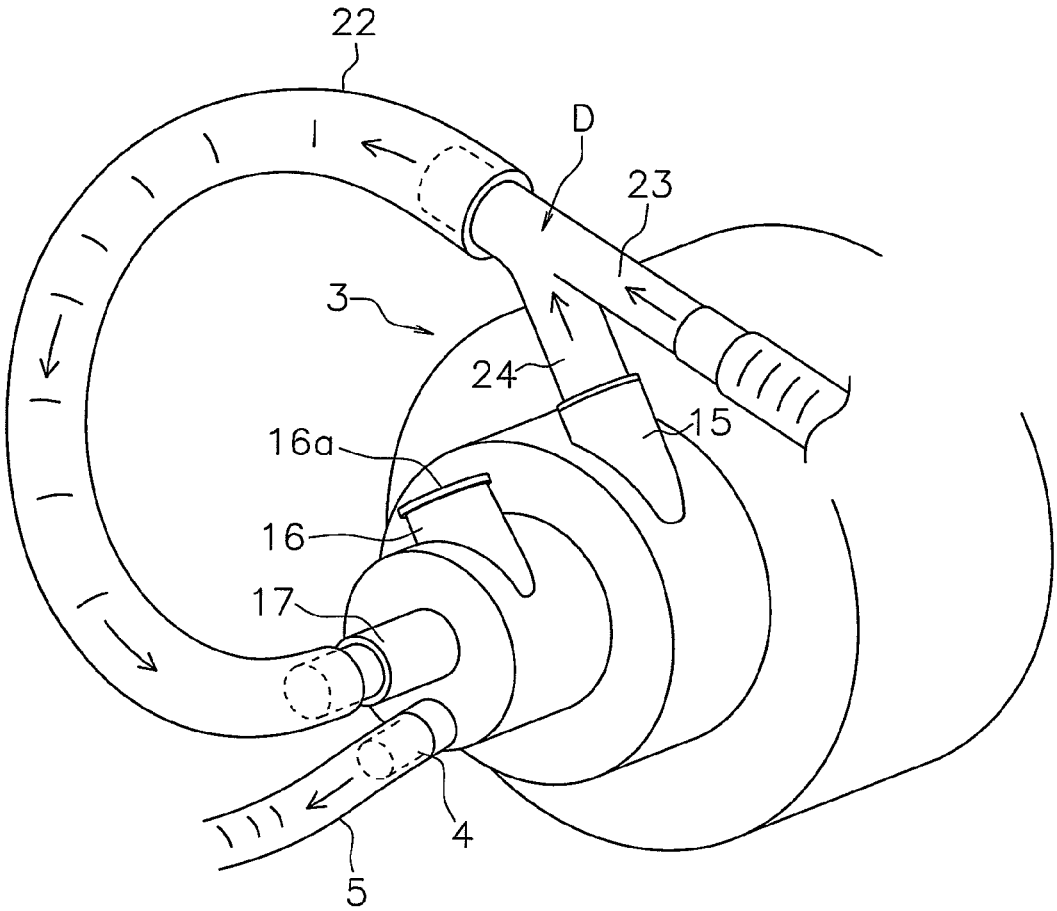
FIG. 10 is a perspective view showing an outer appearance of the pulverizing apparatus according to the second embodiment.

As shown in FIG. 10, the first and second connecting portions 15 and 16 are formed in the outer portions of the classifying space portions S3 and S4 toward tangential directions. In the classifying space portions S3 and S4, the pulverized raw material is rotated, and the tangential direction is set so as to correspond to the rotating direction.

Further, an internal path Q is attached to an inner side of the leading end connecting portion 17, in an inner portion of the classifying space S. A left end portion of the internal path Q is continued to the bypass path P, and a right end portion thereof is open so as to be connected to the classifying space S.

When the raw material is pulverized, the fine grains which are pulverized to the predetermined grain size and the coarse grains which are not pulverized to the predetermined grain size are mixed in the classifying space S. Accordingly, if the bypass path P as mentioned above is provided, the coarse grains having the heavy weight move to the bypass path P side, and are again returned to the classifying space S via the internal path Q. In this manner, the coarse grains are prevented from being discharged from the product discharge port 4, and only the fine grains which are reliably pulverized are discharged from the product discharge port 4. The right end portion of the internal path Q faces to the taper space portion S2 or the first classifying space portion S3, whereby it is possible to return to the internal space S so as to pulverize again.

The leading end connecting portion 17 and the internal path Q are arranged so as to be concentric with an axial center of the internal space S. With this arrangement, it is possible to efficiently pulverize again the returned coarse grains and form the fine grains. Further, the product discharge port 4 is arranged in a periphery adjacent to the leading end connecting portion 17. Note that the arrangement of the product discharge port 4 and the leading end connecting portion 17 is not limited thereto. The leading end connecting portion 17 and the internal path Q may not be arranged concentrically with the axial center of the internal space S.

A lid 16*a* is used in the second connecting portion 16, and does not function in an aspect shown in FIGS. 9 and 10. In the case of configuring the bypass path P, it is possible to select and use any one of the first connecting portion 15 and the second connecting portion 16. Which portion is selected depends on a grade of the raw material. For example, in the case of the raw material in which the specific gravity is relatively low, the second connecting portion 16 positioned in the downstream side is used, and in the case of the raw material in which the specific gravity is relatively high, the first connecting portion 15 positioned in the upstream side is used.

As shown in FIG. 10, an auxiliary path 23 is provided, and merges with a main path at a merging point D. The main path 24 functions as the bypass path P together with the pipe 22. A ring blower (not shown) is connected to the auxiliary path 23, and feeds air in a direction of an arrow. For example, it is possible to regulate a temperature by feeding cooling air. In this case, the auxiliary path 23 is not necessarily provided, and may not be provided.

According to this structure, it is possible to reliably pulverize and discharge the coarse grain, and it is possible to reliably obtain the product having the desired grain size. The coarse grain discharged from the first connecting portion 15 to the bypass path P is introduced in a direction of an illustrated arrow by a negative pressure operation, and is reliably returned into the classifying space S. If the ring blower mentioned above is used, it is possible to return the coarse grain more reliably.

<Results of Experiment>

Figure 11:
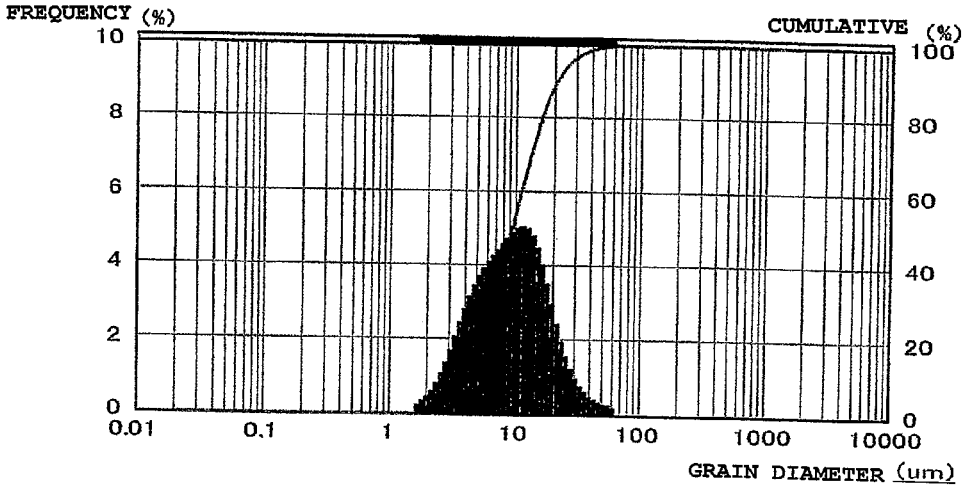
FIG. 11 is a view showing a result of pulverizing experiment (green powdered tea).
Figure 12:
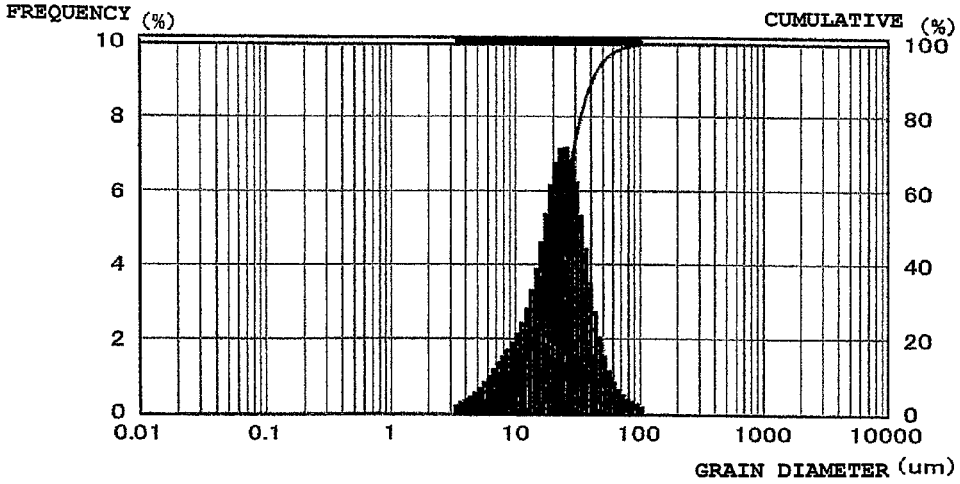
FIG. 12 is a view showing a result of pulverizing experiment (rice).

Next, results obtained by actually carrying out a pulverizing experiment by the pulverizing apparatus according to the second embodiment are shown in FIGS. 11 and 12. FIG. 11 shows results of pulverization of green powdered tea, and FIG. 12 shows results of pulverization of rice. A horizontal axis indicates a diameter (μm) of a grain after being pulverized, a left vertical axis indicates a frequency (%), and a right vertical axis indicates a cumulative frequency (%). In the case of the green powdered tea, an average grain diameter was 9.313 μm, and in the case of the rice, an average grain diameter was 22.25 μm, indicating that they were pulverized to the desired levels.

<Sludge Treatment>

The pulverizing apparatus according to the present invention can also be applied to a sludge treatment, as described in detail below. A structure called as a sludge in an industrial waste is a mixed waste of a solid material and a water content. Such a sludge is constituted by an inorganic sludge composed of an inorganic substance or the like, and an organic sludge derived from a biochemical waste water treatment. Further, a sewage water discharged by life of a human being is separated into household drainage and firm drainage, and is treated according to various methods. One half of the sludge discharged in the treating process is the treatable organic sludge.

At present, the above-mentioned sludge is dehydrated and is thereafter subjected to landfill disposal. However, a free space of a landfill site is reduced year by year, and it is demanded to reduce a surplus sludge.

Since about 90% of sludge bacteria is constituted by a water content, and is covered by a strong cell surface membrane, it is hard to rupture it. Therefore, a surface thereof is generally dried so as to be subjected to landfill disposal, or burned in a furnace.

For reducing the surplus sludge, there has been made a study of reduction by a bead mill or disc type pulverization. However, the pulverization of the sludge including the water content has a lot of difficult sides, and has not been put to practical use under the present circumstances. In other words, under the property of the cell surface membrane included in the sludge bacteria, it is hard to pulverize by means of pressing, pressurizing, hitting and triturating.

The pulverizing apparatus according to the present invention not only has a function of a gas flow pulverizing technique by means of a normal jet mill (a technique of pulverizing by generating a gas flow within the pulverizing chamber, and causing a subject to collide against a casing by a high-speed eddy current, or causing the pulverized subjects to collide against each other, or causing the pulverized subject to collide against a rotating body), but also a function of creating opposite negative pressure states in front and rear sides around a rotor rotating at a high speed, and rupturing the subject to be pulverized in a high-pressure gas flow. In this manner, it is possible to pulverize the sludge by the pulverizing apparatus according to the present invention.

Note that the temperature within the pulverizing chamber is preferably set to about 120° C. or higher. As a structure of a heat source for heating, appropriate structures can be employed. For example, it is possible to employ such a structure as to supply the raw material from a position of the hopper 2 and feed a hot wind having a predetermined temperature in the pulverizing chamber. Further, other heaters may be provided within the pulverizing chamber.

By performing an experiment by actually inserting the sludge, 1 kg sludge was reduced to 120 g.

Other Embodiments

The raw material which is pulverized by the pulverizing apparatus according to the present invention is not particularly limited, however, the pulverizing apparatus is particularly preferable for foods such as green tea, black tea, coffee bean, soy, red bean, rice, layer and the like.

The number of the rotors can be properly used, for example, one to ten in correspondence to the pulverized grain size or the pulverized raw material.

In the present embodiment, two classifying space portions are formed, however, the set number can be appropriately decided. The set number of the connecting portions for forming the bypass path P can be changed in correspondence to this number.

In the present embodiment, the product discharge port 4 may be provided in the outer portion in the circumferential direction of the classifying space portion.

The invention claimed is:

1. A pulverizing apparatus comprising:

a raw material supply port provided in one end side;

a product discharge port provided in the other side;

a raw material pulverizing chamber for pulverizing a raw material supplied from the raw material supply port so as to discharge from the product discharge port;

a rotor arranged in an upstream side within the raw material pulverizing chamber and formed by at least one thin plate;

a cylindrical space in which the rotor is accommodated;

a classifying space arranged in a downstream side of the cylindrical space and having a cylindrical shape with an inner diameter set smaller than the cylindrical space; and the product discharge port arranged in a downstream side of the classifying space, wherein the pulverizing apparatus pulverizes by causing the raw materials to collide against each other, or causing the raw material to collide against an inner wall surface of the raw material pulverizing chamber, by a gas flow generated by a rotation of the rotor.

2. The pulverizing apparatus according to claim 1, wherein the rotor is structured such that a plurality of rotors are arranged side by side along a direction of a rotating axis, and regulates a grain size of a product by structuring an arrangement interval of the rotors adjustable.

3. The pulverizing apparatus according to claim 1, wherein the classifying space has at least two classifying space portions having different inner diameters, and is set such that the inner diameter becomes smaller toward a downstream side.

4. The pulverizing apparatus according to claim 1, wherein the classifying space is adjacent to the cylindrical space and is provided with a taper space portion in which the inner diameter becomes gradually smaller as being far from the cylindrical space.

5. The pulverizing apparatus according to claim 1, further comprising:

a bypass path arranged in an outer portion of the classifying space and bypassing a leading end side of the classifying space from an upstream side of the classifying space; and an internal path arranged in an inner portion of the classifying space and connected from the leading end side of the classifying space to the upstream side of the classifying space, wherein the pulverizing apparatus is structured such as to return a coarse grain discharged to the bypass path side, in the pulverized raw material, again into the classifying space via the internal path.

6. The pulverizing apparatus according to claim 5, wherein a plurality of connecting portions for connecting the bypass path are provided in an outer portion of the classifying space, and are selectable in correspondence to a grade of the raw material.

* * * * *